United States Patent [19]

Schieber et al.

[11] 4,180,992

[45] Jan. 1, 1980

[54] PATTERN SETTING ARRANGEMENT OF KNITTING MACHINE

[75] Inventors: Hans Schieber; Krause Erich both of, Bopfingen; Reinhold Schimko, Aalen-Wasseralfingen, all of Fed. Rep. of Germany

[73] Assignee: Universall Maschinenfabrik Dr. Rudolf Schieber GmbH & Co., KG, Westhausen, Fed. Rep. of Germany

[21] Appl. No.: 914,716

[22] Filed: Jun. 12, 1978

[30] Foreign Application Priority Data

Jun. 23, 1977 [DE] Fed. Rep. of Germany ..... 2728343

[51] Int. Cl.[2] ..... D04B 7/00

[52] U.S. Cl. ..... 66/75.1

[58] Field of Search ..... 66/75.1, 75.2, 154

[56] References Cited

U.S. PATENT DOCUMENTS

| | | | |
|---|---|---|---|
| 3,611,753 | 4/1970 | Krause | 66/75.1 |
| 3,699,782 | 10/1972 | Hadam | 66/75.1 |
| 3,892,108 | 7/1975 | Hadam | 66/75.2 |
| 4,041,732 | 8/1977 | Krause | 66/75.2 |

OTHER PUBLICATIONS

"Universal V Bed Flat Machine Equipped with Pattern Drums Instead of Cards", Knitting Times, Sep. 27, 1971, Vol. 40, No. 40 pp. 52–54.

Itma Special: 3, "Hosiery Trade Journal", Jun. 1971 Vol. 78, No. 930. pp. 132–133–136–137.

*Primary Examiner*—Ronald Feldbaum

*Attorney, Agent, or Firm*—Sughrue, Rothwell, Mion, Zinn and Macpeak

[57] ABSTRACT

Needles in knitting machines are selected for pattern purposes by a lever system operated by a pattern drum mounted on a carriage passable to and fro over the needle bed. The lever system incorporates locking-sinkers provided with contact feet in staggered relationship so that different force requirements apply to different ones of the rocking sinkers. The present invention provides an additional foot on the end of each rocking sinker and a cam element on the carriage to engage the said additional feet of the rocking sinkers selected by the pattern drum fully to depress the selected rocking sinkers whereby to ensure actuation of the selected needles.

7 Claims, 5 Drawing Figures

PATTERN SETTING ARRANGEMENT OF KNITTING MACHINE

BACKGROUND OF THE INVENTION

The invention relates to a pattern setting arrangement of a knitting machine having a needle bed and a carriage passable over the needle bed, at least one pattern drum carried by the carriage and a plurality of rocking sinkers and directly or indirectly associated needles movably mounted in channels in the needle bed, the position of the rocking sinkers being determined by pressure bars selectable by the pattern drum and operating on feet on rear lever arms of the respective rocking sinkers.

With such pattern setting arrangements the choice of the needles occurs in that the pressure bars are controlled through pattern cams formed in accordance with the pattern and arranged on the periphery of the pattern drum. The pressure bars then select pattern sinkers by way of the rocking sinkers which, for their part, select the needles then actuated by cams on the carriage.

One such pattern device is, for example, shown in German Pat. Specification No. 1 922 289. In this known pattern device springs are located under the rocking sinkers and always hold these in their upper position. In this case needle beds with very deep slits are necessary which must often be manufactured in several parts. As a result of the pressure exerted by the springs it is also not possible to make use of pressure bars which are located very close to each other and, therefore, are very slender and to apply pressure directly on the feet of the rocking sinkers. Such slender pressure bars would give sideways so that there would be many failures.

Pattern devices are also known in which the rocking sinkers are journalled in the needle channels without the use of springs and are held in the needle channels with some degree of position stability by an interference fit. Rocking sinkers built in this way can only be formed with few feet so that a distinct limitation of the pattern possibilities results. If these rocking sinkers are, on the other hand, selected by electrically controlled pressure bars, then the knitting speed is severely restricted. Further the rocking sinkers of this known pattern device must be continuously brought out of their working position into their normal position by pressure applied on their shorter forward lever arms. This in turn means that the rear lever arm, on which the feet are arranged for selection, can not be made as long as desired since the friction load with a large lever ratio can only be overcome with very high specific pressure.

SUMMARY OF THE INVENTION

It is an object of the present invention to provide a pattern setting arrangement of the afore-described type with which it is possible to provide a unitary needle bed for the needles and rocking sinkers with relatively shallow needle canals and which renders possible an unlimited, simple and sure selection and actuation of the rocking sinkers selected in accordance with the pattern.

In accordance with the present invention additional feet are provided on the free ends of the rear lever arms and extend longitudinally of the needles and out of the channels in the needle bed and cam element means mounted on the carriage have a portion thereof engageable with the said additional feet of selected ones of the rocking sinkers upon passage of the carriage over the needle bed for pressing said rear lever arms of said selected ones of the rocking sinkers into their respective channels in the needle bed into first, working, positions of the rocking sinkers.

Preferably said cam element means has further portions thereof for engaging said additional feet for holding said selected rocking sinkers in their working positions during a knitting cycle, and preferably also said cam element means has further portions thereof for engaging said additional feet for returning the rocking sinkers to their normal non-working positions at the end of the knitting cycle.

With this arrangement the rocking sinkers are selected in accordance with the pattern and brought into a position in which they can be contacted by the single cam element of the carriage, brought into their working position and held there. After the release of the additional foot of the rocking sinker from the engagement with the one portion of the cam element a further portion of the cam element engages the additional foot of the rocking sinker and presses this back into its normal position.

Advantageously a hook means extending into the needle channel is provided on the rear lever arm of the rocking sinker. This hook holds the rocking sinker against rotation in the needle channel.

Advantageously the hook means is bent out of the horizontal plane of the rocking sinker. Thereby it restrains the rocking sinker in the needle channel and holds the rocking sinker position stable at least in its upper position or normal position.

Further the needle bed advantageously includes a recess running along the needle bed on its underside in the region of the hook means.

With this it is ensured that the hook means can swing freely downwardly without having to form in the needle bed a transverse groove which is difficult to manufacture.

Usefully, a nose is provided on the forward lever arm of the rocking sinker as abutment means for the associated needle or pattern sinker.

Furthermore the rocking sinker is advantageously provided at its pivot point with a protrusion located in a longitudinal groove in the needle bed, while a cover plate is provided over this pivot point. In this way the pivot point of the rocking sinker is fixed in a definite and simple way.

A useful further development of the invention consists in that an upstanding lever arm is formed integrally at one end of the pressure bar and lies laterally against a pattern cam of the pattern drum. In this way the selection drum with its bearings does not have to be moved. The lever arm of the pressure bar preferably lies against the cam under the action of a spring.

In order to hold the pressure bar securely in its position after selection through the pattern drum, there is usefully provided a device for holding the pressure bar in its working position. This device is advantageously a safety catch which comes into engagement with a protrusion on the free end of the pressure bar.

DESCRIPTION OF THE PREFERRED EMBODIMENT

Figure 1:
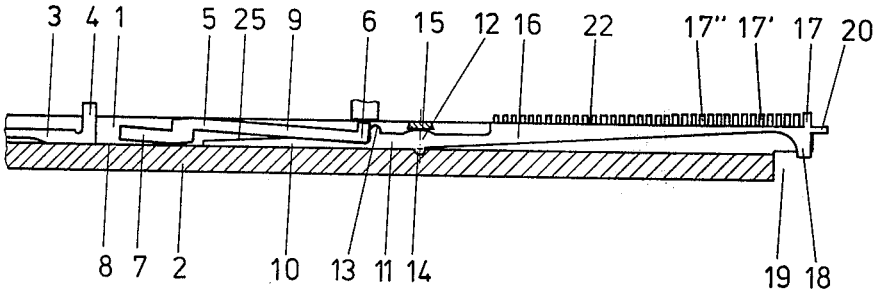
FIG. 1 is a schematic cross section through a part of a needle bed of a presently preferred embodiment of a knitting machine with a rocking sinker for selection in accordance with the pattern in its normal position.
Figure 2:
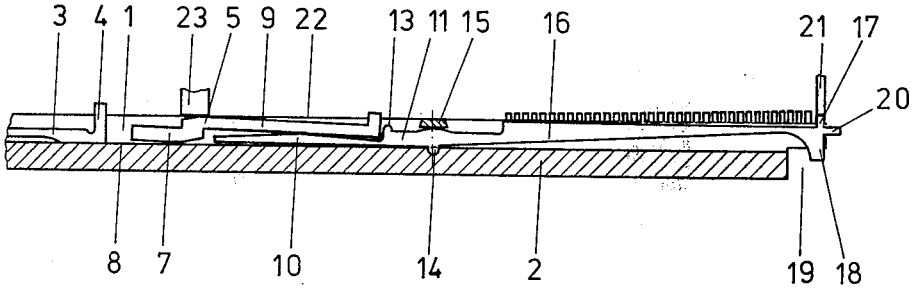
FIG. 2 is a cross section as in FIG. 1 in which the rocking sinker is however pressed down by a pressure bar and the associated pattern sinker is lifted up partly out of the needle channel.
Figure 3:
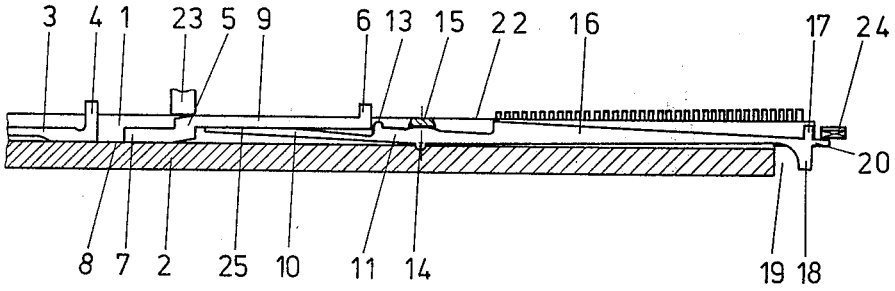
FIG. 3 is a cross section as in FIG. 1 in which however the rocking sinker is held in its working position by a cam element and the pattern sinker is raised into its working position and held there.

In FIGS. 1 to 3 a needle bed 2 is shown in cross section so that a needle channel 1 is clearly to be recognised. A needle 3 is slidably located in the needle channel 1 and has a foot 4 extending up out of the needle bed 2 so that it can be engaged by parts of a cam moved over the needle bed 2. In the needle channel 1 there is also slidably and pivotably mounted a pattern sinker 5 whose foot 6 can extend up out of the needle bed 2 or sink into the needle bed 2 in accordance with the position of the pattern sinker 5. FIG. 1 shows the foot 6 in its position fully sunk into the needle bed.

The pattern sinker 5 is so shaped that it can slide with a forward shank 7 on the floor 8 of the needle channel and that there is room in the channel for a shank 10 of a forward lever arm 11 of a rocking sinker 12 together with a rear shank 9 of the pattern sinker. In addition, a nose 13 is provided on the forward lever arm 11 of the rocking sinker 12 which serves as an abutment for the pattern sinker 5.

The rocking sinker 12 has a protrusion 14 in the region of its pivot point by which it is located in a groove in the needle bed 2. A cover piece 15 covers over and locates the rocking sinker in the region of its pivot point.

The plurality of rocking sinkers have respective rear lever arms on which are provided upstanding feet 17, 17′ and 17″ spaced with respect to the associated pivot points. The feet 17, 17′, 17″ of the adjacent rocking sinkers are arranged in staggered form with different spacing from the pivot points.

The rocking sinker 12 has a rear lever arm 16 on which the foot 17 is located at the rearmost end of the rearward lever arm 16.

The rearward lever arm 16 of the rocking sinker 12 is so shaped that it terminates in a turn-under hook 18 which ensures that the rocking sinker 12 cannot rock sideways under sideways pressure. A recess 19 is provided on the underside of the needle bed 2 in the region of the hook 18 in which the hook 18 can move freely if the rocking sinker 12 is pushed out of its normal position shown in FIG. 1 into its working position (FIGS. 2 and 3). Furthermore the rearward lever arm 16 with its hook 18 is so bent and formed that it is an interference fit in the needle channel and a frictional braking effect or restraint exists in the needle channel which holds the rocking sinker 12 stable in each pivoted position.

At the rearward end of the rearward lever arm 16 of the pivoting sinker 12 there is provided a foot 20 extending longitudinally or rearwardly out of the needle bed 2. Pressure bars 21 run over the feet 17, 17′, 17″ extending upwardly out of the needle bed and these are so selected in accordance with the pattern that, in the course of a pass, they either press the associated foot 17, 17′ or 17″ hard to the upper face 22 of the needle bed or slide over the associated foot.

Now should the pressure bar 21 press the associated foot 17 of the rocking sinker 12 downwardly, then the rocking sinker 12 swings about its pivot point defined by the protrusion 14 and lifts or swings, with its forward shank 10, the pattern sinker 5, which is uncovered by a cam part 23 on the passage of the carriage, so far that its foot 6 extends half out of the needle bed. Furthermore, the foot 20 of the rocking sinker 12 is swung so far downwardly that it can be engaged by a cam element 24. This cam element 24 on the cam carriage now swings the rocking sinker 12 so far that its shank 20 stands with a slope 25 parallel to the upper surface 22 of the needle bed. Meanwhile the pattern sinker 5 is swung so far that its foot 6 extends wholly out of the needle bed 2 and can therefore be engaged by an associated part of the cam. This position, in which the under edge of the shank 9 of the pattern sinker 5 can slide on the slope 25 of the rocking sinker 12 is illustrated in FIG. 3. A pattern sinker can thus be presented in accordance with the pattern to a cam (not illustrated) and moved by this. In this movement they then bring the needles 3 or their feet 4 in the engagement zone of the knitting lock (equally not illustrated).

Figure 4:
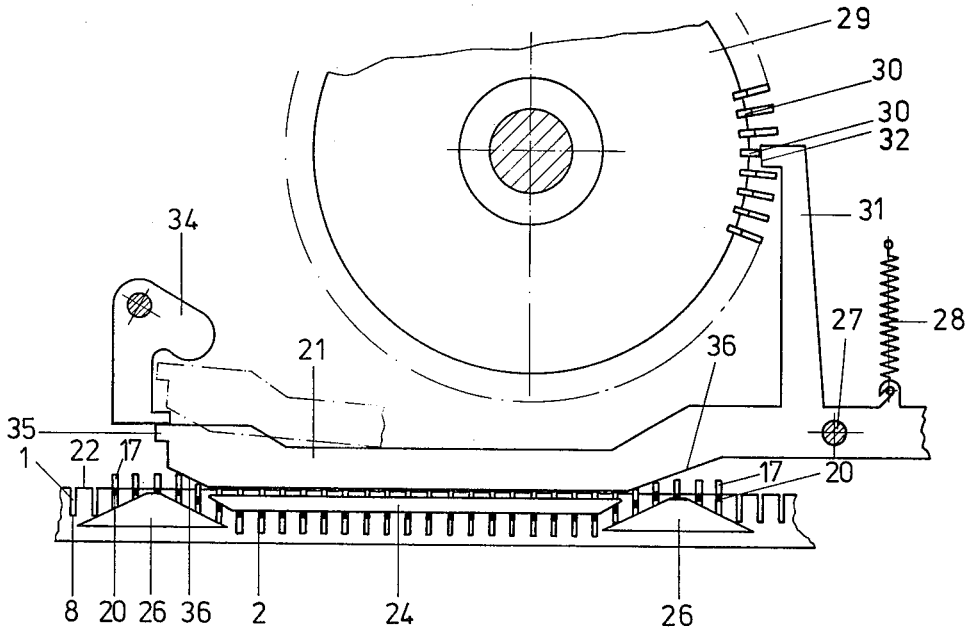
FIG. 4 is a plan view on the rear side of the needle bed of FIG. 1 together with a schematically illustrated carriage showing the cam together with the pattern drum and the orientation of the feet of the rocking sinkers on insertion of the pressure bar.
Figure 5:
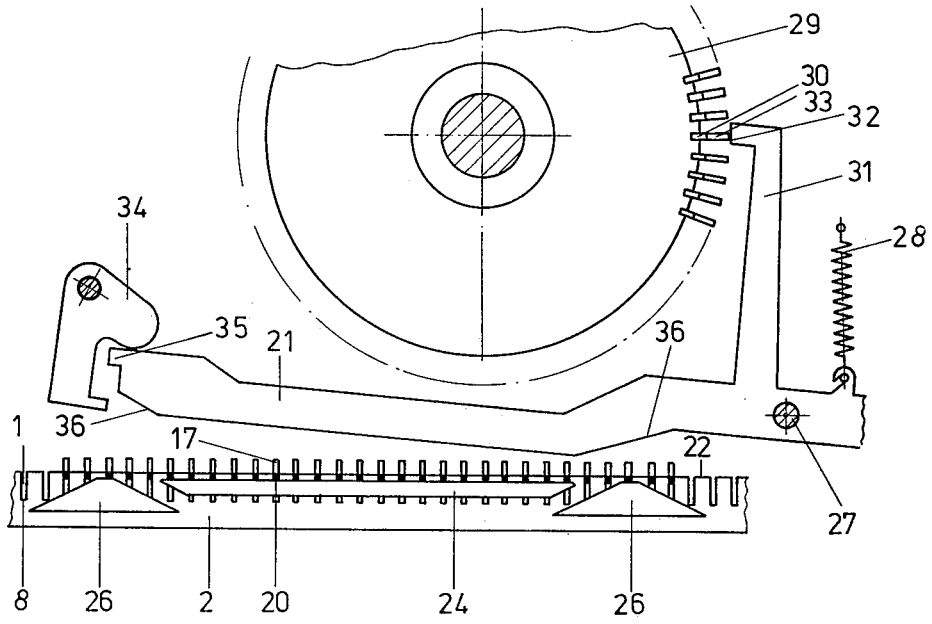
FIG. 5 is a plan view as in FIG. 4 however with the pressure bar not inserted.

In FIGS. 4 and 5 the cam element 24 can clearly be recognised in its outward pass in the direction of movement of the carriage. The rocking sinkers are held in a stable position by means of the cam element 24 engaging their feet extending rearwardly out of the needle bed as long as the pattern sinkers 5 function by reason of their associated cam. Thereafter the rocking sinkers are lifted again into their normal position through the lock elements 26 which engage on the underside of the rearwardly extending feet of the rocking sinkers.

The pressure bars are pivotally mounted about a pivot point 27 on the carriage (not illustrated) and each have a lever arm 31 which is pressed by means of a spring 28 against a pattern drum 29 on the carriage having pattern cams 30. The pattern cams 30 are shaped in accordance with the pattern and allow the lever arm 31 of a pressure bar in one case to lie through its contact face 32 against the tooth 33 of a pattern cam 30, whereby the pressure bar is held in its non-working position as shown in FIG. 5. If the tooth 33 is, on the other hand, broken away in accordance with the pattern, then the lever arm 31 comes by way of its contact face 32 into contact with the bar of the pattern cam 30 as is shown in FIG. 4. In this position the pressure bar 21, for example, is held fast by a safety catch 34 on a protrusion 35 and, during the passage over the needle bed, presses, by its slope 36, the foot 17 of the rocking sinker 12 so far into the needle bed 2 that the cam element 24 can engage the foot 20 of the rocking sinker 12 extending rearwardly out of the needle bed.

The cam element 24 has, in the illustrated example, a slope for engaging the rearwardly extending feet of selected rocking sinkers in both running directions. Furthermore there is provided, on both sides of the lock element 24, a respective cam element 26 for the return pressure of the rocking sinkers into their normal position so that these cam elements can also work during a movement of the carriage in both directions. It is understood that the pressure bars must also include a slope corresponding to the slope 36 on both sides in order to be able to bring the rearwardly extending feet into the region where they can be engaged by the cam element 24 in both directions of passage of the carriage.

We claim:

1. In a pattern setting arrangement for a knitting machine having a needle bed, a plurality of needles movably mounted in channels in said needle bed, a carriage movable over said needle bed, at least one pattern drum carried by said carriage, the plurality of rocking sinkers disposed in said channels, said rocking sinkers having rearwardly extending lever arms provided with upstanding feet, and pressure bar means mounted on said carriage in operative relationship with said pattern drum for determining the position of said rocking sinkers through operable engagement with said feet on said rearwardly extending lever arms of said rocking sinkers, the improvement comprising each rocking sinker having an additional foot disposed on the free end of said rearwardly extending lever arm and extending longitudinally of and outwardly beyond said channels and fixed cam means mounted on said carriage for engaging said foot on selected ones of said rocking sinkers upon passage of the carriage over the needle bed for pressing said rearwardly extending lever arms of said selected ones of said rocking sinkers into a working position within their respective channels, for holding said selected rocking sinkers in said working position during a knitting cycle and for returning said rocking sinkers to their normal non-working positions at the end of a knitting cycle, each of said rocking sinkers having hook means on said rearwardly extending lever arm and extending downwardly into a respective channel of said needle bed.

2. An arrangement as claimed in claim 1, wherein the underside of the needle bed is formed with a recess in the region of the hook means.

3. An arrangement as claimed in claim 1, wherein a protrusion is formed on the rocking sinker at its pivot point in the needle channel and a groove is formed in the needle bed at said point, the protrusion being journalled in the groove, and wherein a cover piece is secured to the needle bed and extends over the rocking sinker at that point.

4. An arrangement as claimed in claim 1, wherein an upstanding lever arm is formed integrally with a said pressure bar and lies laterally against a pattern cam mounted on the pattern drum.

5. An arrangement as claimed in claim 4, wherein a spring urges the lever arm of the pressure bar against the respective pattern cam.

6. An arrangement as claimed in claim 4, including means for locking the pressure bar in its working position.

7. An arrangement as claimed in claim 6, wherein said locking means is a safety catch and a protrusion on the free end of the pressure bar engageable with the safety catch.

* * * * *

UNITED STATES PATENT AND TRADEMARK OFFICE

CERTIFICATE OF CORRECTION

PATENT NO. : 4,180,992

DATED : January 1, 1980

INVENTOR(S) : Hans Schieber, Erich Krause & Reinhold Schimko

It is certified that error appears in the above-identified patent and that said Letters Patent are hereby corrected as shown below:

IN THE HEADING:

Please delete the assignees name reading "Universall Maschinenfabrik Dr. Rudolf Schieber GmbH & Co., KG" and substitute therefor --UNIVERSAL MASCHINENFABRIK DR. RUDOLF SCHIEBER GmbH & CO., KG--.

Signed and Sealed this

*Sixth* Day of *May 1980*

[SEAL]

*Attest:*

SIDNEY A. DIAMOND

*Attesting Officer*

*Commissioner of Patents and Trademarks*